US009073026B2

(12) United States Patent
Engels et al.

(10) Patent No.: US 9,073,026 B2
(45) **Date of Patent: *Jul. 7, 2015**

(54) APPARATUS FOR DISPENSING A PLURALITY OF FLUIDS

(75) Inventors: Marcel Hendrikus Petrus Engels, Voorhout (NL); Martin Kruit, Voorhout (NL); Nico Van Beelen, Katwijk (NL); Ronald Peter Krom, Katwijk (NL); Marcus Johannes Voskuil, Oegstgeest (NL); Mattijs Oostendorp, Nootdorp (NL)

(73) Assignee: Fast & Fluid Management B.V., Sassenheim (NL)

( * ) Notice: Subject to any disclaimer, the term of this patent is extended or adjusted under 35 U.S.C. 154(b) by 0 days.

This patent is subject to a terminal disclaimer.

(21) Appl. No.: 13/978,662

(22) PCT Filed: Dec. 9, 2011

(86) PCT No.: PCT/EP2011/072362
§ 371 (c)(1),
(2), (4) Date: Oct. 10, 2013

(87) PCT Pub. No.: WO2012/093020
PCT Pub. Date: Jul. 12, 2012

(65) Prior Publication Data

US 2014/0034674 A1 Feb. 6, 2014

Related U.S. Application Data

(63) Continuation of application No. 12/986,307, filed on Jan. 7, 2011.

(51) Int. Cl.
*B67D 7/78* (2010.01)
*B01F 13/10* (2006.01)
(Continued)

(52) U.S. Cl.
CPC ..... *B01F 13/1055* (2013.01); *B01F 7/00216* (2013.01); *B01F 7/00275* (2013.01);
(Continued)

(58) Field of Classification Search
CPC ..... B01F 7/00008; B01F 7/00133; B01F 7/00158; B01F 7/0025; B01F 7/00625; B01F 7/16; B01F 7/162; B01F 7/1695; B01F 7/18; B01F 7/20; B01F 7/00216; B01F 7/00275; B01F 7/00633; B01F 13/1072; B01F 13/1058; B01F 13/1063; B01F 13/1066; B01F 13/1055; B01F 15/00538; B01F 2003/0028; B01F 2015/00623; B01F 2215/005
USPC ..... 222/23, 63, 132, 135, 144, 144.5, 222/185.1, 233
See application file for complete search history.

(56) References Cited

U.S. PATENT DOCUMENTS 4,403,866 A 9/1983 Falcoff et al.
(Continued)

FOREIGN PATENT DOCUMENTS

EP 0800858 A1 10/1997
EP 0813901 A1 12/1997
(Continued)

OTHER PUBLICATIONS

International Search Report and Written Opinion for related International Application No. PCT/EP2011/072362; report dated Sep. 12, 2011.

*Primary Examiner* — Patrick M Buechner
(74) *Attorney, Agent, or Firm* — Miller, Matthias & Hull LLP

(57) ABSTRACT

An apparatus for dispensing a plurality of fluids, comprising a support, such as a turntable or a linear table, a plurality of containers for holding a fluid and mounted on the support, pumps and valves connected to respective containers, at least a common actuator for sequentially operating the pumps and a common actuator for sequentially operating the valves to dispense fluid and a drive mechanism for moving the support, and thus the containers, pumps, and valves on the one hand and the actuator on the other relative to each other. The common actuators for sequentially operating the pumps and valves and optionally the drive mechanism for relative motion of the support are integrated in a module, which module is releasably mounted in the apparatus.

16 Claims, 5 Drawing Sheets

(51) Int. Cl.

| | |
|---|---|
| ***B01F 7/00*** | (2006.01) |
| *B01F 3/00* | (2006.01) |
| *B01F 15/00* | (2006.01) |

(52) U.S. Cl.

CPC ..... *B01F 7/00633* (2013.01); *B01F 13/1058* (2013.01); *B01F 13/1063* (2013.01); *B01F 13/1066* (2013.01); *B01F 2003/0028* (2013.01); *B01F 2015/00623* (2013.01); *B01F 2215/005* (2013.01)

(56) References Cited

U.S. PATENT DOCUMENTS

| | | | | |
|---|---|---|---|---|
| 5,622,692 | A | 4/1997 | Rigg et al. | |
| 6,945,431 | B2 * | 9/2005 | Miller | 222/144 |
| 7,347,344 | B2 * | 3/2008 | Engels et al. | 222/144 |
| 7,360,564 | B2 * | 4/2008 | Engels et al. | 141/83 |
| 7,527,078 | B2 * | 5/2009 | Driessen et al. | 141/9 |
| 8,448,823 | B2 * | 5/2013 | Engels et al. | 222/144 |
| 2005/0087545 | A1 * | 4/2005 | Petrus Engels et al. | 222/1 |
| 2005/0269367 | A1 * | 12/2005 | Post | 222/185.1 |
| 2006/0169718 | A1 | 8/2006 | Buining et al. | |
| 2006/0175571 | A1 * | 8/2006 | Held et al. | 251/315.03 |
| 2007/0044863 | A1 * | 3/2007 | Engels et al. | 141/83 |
| 2009/0236367 | A1 | 9/2009 | Voskuil et al. | |
| 2011/0122196 | A1 * | 5/2011 | Hill | 347/47 |
| 2012/0175383 | A1 * | 7/2012 | Engels et al. | 222/135 |
| 2012/0175385 | A1 * | 7/2012 | Voskuil | 222/144 |

FOREIGN PATENT DOCUMENTS

| | | | |
|---|---|---|---|
| EP | 1090679 | A1 | 4/2001 |
| EP | 1134186 | B1 | 5/2003 |
| EP | 2198950 | A1 | 6/2010 |
| FR | 1340860 | A | 10/1963 |
| WO | 0013918 | A1 | 3/2000 |
| WO | 2005039747 | A2 | 5/2005 |
| WO | 2005082510 | A2 | 9/2005 |
| WO | 2005107933 | A1 | 11/2005 |
| WO | 2010113008 | A1 | 10/2010 |

* cited by examiner

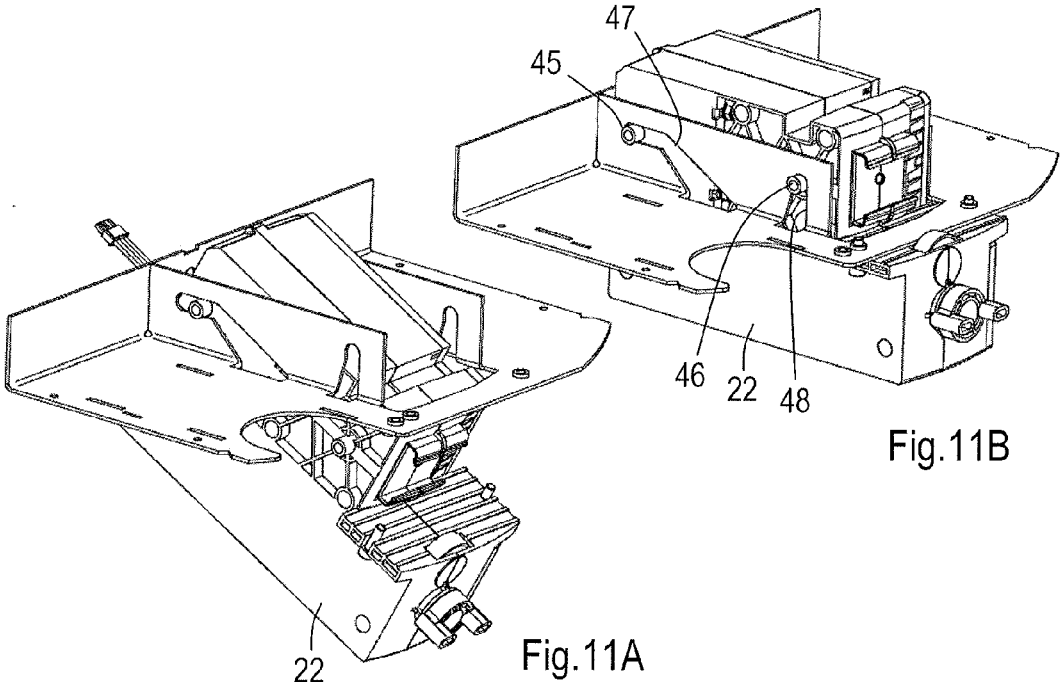
Fig.11B
Fig.11A
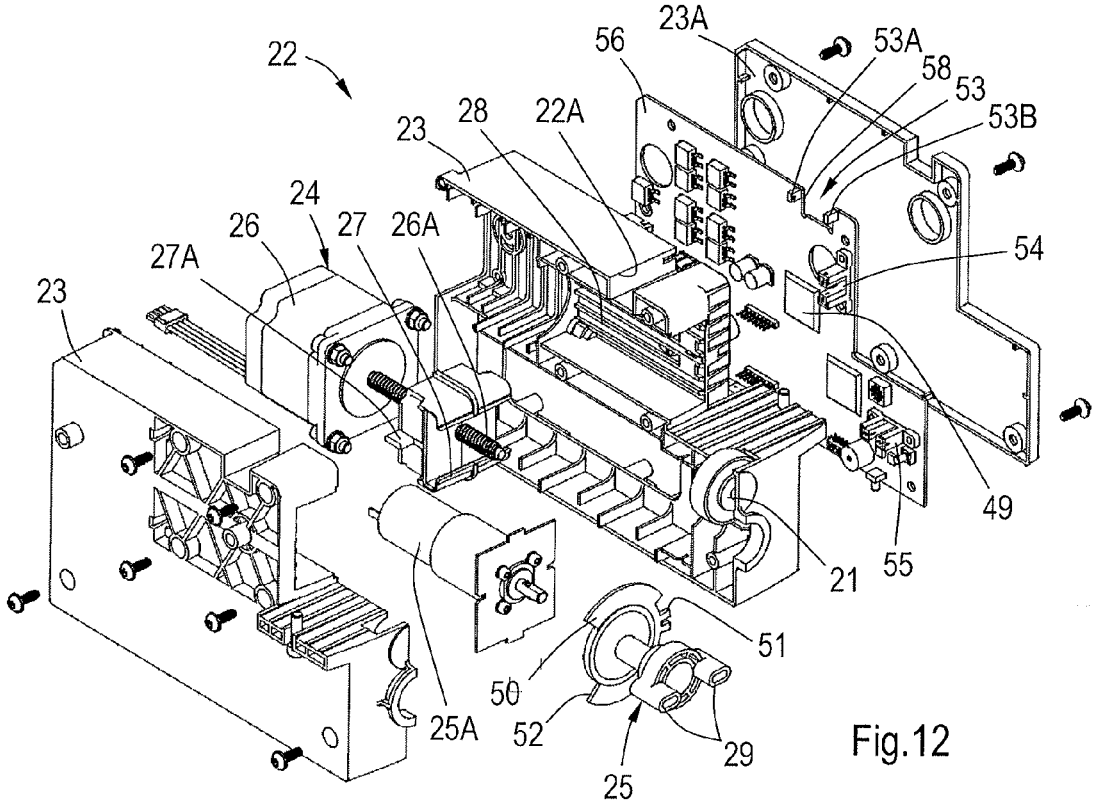
Fig.12

APPARATUS FOR DISPENSING A PLURALITY OF FLUIDS

CROSS-REFERENCE TO RELATED APPLICATIONS

This application is a 35 USC §371 U.S. national stage filing of International Patent Application No. PCT/EP2011/072362 filed on Dec. 9, 2011, which claims priority under the Paris Convention and 35 USC §119 to U.S. patent application Ser. No. 12/986,307, filed on Jan. 7, 2011.

FIELD OF THE DISCLOSURE

1. Background

The invention relates to an apparatus for dispensing a plurality of fluids, comprising a support, such as a turntable or a linear table, a plurality of containers for holding a fluid and mounted on the support, pumps and valves connected to respective containers, at least a common actuator for sequentially operating the pumps and a common actuator for sequentially operating the valves to dispense fluid, thus defining a dispense position, and a drive mechanism for moving the support, and thus the containers, pumps, and valves on the one hand and the actuator on the other relative to each other.

2. Background of the Disclosure

EP 800 858 relates to a dispensing apparatus (indicated by 10 in the Figures of EP 800 858) which includes canisters (72) mounted on a turntable (74), the canisters (72) including dispense pumps (130) and valves (136). Actuators for operating the dispense pumps (130) and valves (136) are located on a service door (16) mounted alongside the turntable (74).

US 2006/0169718 relates to a dispenser apparatus including a centrally located vertically mounted column assembly. A plurality of canisters is cantilever mounted to the column assembly. Each canister has a receptacle for holding a fluid and each receptacle includes a corresponding pump for dispensing fluid held therein. The dispenser apparatus also includes a stationary dispensing station having a mechanism for selectively actuating the pump for dispensing fluid held in the receptacle. A mechanism is also provided for engaging a portion of a canister to align a pump corresponding to a receptacle to the stationary dispensing station, wherein the fluid held in the receptacle may be dispensed.

Similar apparatuses are known from WO 2010/113008, WO 2005/107933, WO 2005/039747, EP 1 134 186, and EP 1 090 679.

WO 00/13918 relates to a carousel-type paint toning machine comprising a frame (1); a carousel base (3) arranged rotatably in an upper part (2) of the frame; containers (4) for toning paste, arranged in a circle on the carousel base; means (5) for rotating the carousel base (3); means for mixing the paste in the paste containers, the means comprising a mixer (6) inside each paste container and a gearwheel (7) connected to the mixer and situated below each container; and means (8) for rotating the gearwheels (7) connected to the mixers. In order to reduce the costs of manufacturing the machine, the carousel base (3) and the means (8) for rotating the gearwheels (7) connected to the mixers (6) are formed by cutting them from a single plate.

WO 2005/082510 relates to automatic and manual colorant and hair dye dispensers. The embodiment shown in FIG. 96 shows a stirring arrangement comprising canister-receptacle gears (240, 247) mounted to the bottom of a given stirring rod (221) that projects downwardly from a respective canister. A stirring station or device (242) has a drive gear (244) rotatably mounted on a lever arm (245). The lever arm (245) may be rotated, for example, by means of a bidirectional rotary disc (248) having a guide pin (249) that rides in a guide slot (250) at the free end (251) of the lever arm (245).

EP 2 198 950 relates to an apparatus for dispensing a plurality of fluids, comprising a support, such as a turntable (2) or a linear table, a plurality of containers (4) for holding a fluid mounted on the support (2), pumps (3) connected to respective containers (4), a common actuator (31) for sequentially operating the pumps (3), stirring elements mounted rotatably inside and extending from the containers (4), and a drive mechanism (21) for rotating the stirring elements, wherein the support (2) on the one hand and the actuator (31) and drive mechanism (21) on the other are movable relative to each other. The drive mechanism (21) comprises a protrusion (26) movable between at least a first, extended position (FIG. 2B) for engaging a stirring element (20) and a second, retracted position (FIG. 2A).

Similar apparatuses are known from WO 2010/113008 and EP 813 901.

It is an object of the present invention to provide an apparatus for dispensing a plurality of fluids that allows more straightforward assembly and/or maintenance.

SUMMARY OF THE DISCLOSURE

To this end, the common actuator for sequentially operating the pumps and the common actuator for sequentially operating the valves and optionally the drive mechanism for relative motion of the support are integrated in a module, which module is releasably mounted in the apparatus.

Thus, the module can be manufactured separately and if during use, e.g. at a point of sale, the apparatus malfunctions, the user or a mechanic can quickly and in a straightforward manner replace (swap) the module with a properly working module to render the apparatus operational again.

In one aspect, the module is positioned beneath the support and/or behind the pumps, i.e. on the side of the containers remote from the actual point of dispensing, and, in case the apparatus comprises a turntable, inside the (outer) ring of the pumps. In a further aspect, the pumps are piston-pumps and extend substantially radially and preferably substantially horizontally.

Thus, the module does not interfere with other components, in particular the turntable and components mounted on the turntable, and/or the point of dispensing can be positioned more towards the front of the apparatus.

In a further aspect, the module comprises sensors for the position of the support, the position of the pump and/or its actuator, and the state of the valve and/or the position of its actuator, and a controller for operating the actuators and thus the pumps and valves to dispense fluid. To further facilitate assembly, it is preferred that the controller and at least one preferably all of the sensors are mounted on the same substrate, such as a printed circuit board. Thus, the sensors require no separate substrate or cables. Also, it is preferred that at least one of the sensors is a slotted sensor, e.g. a slotted optical sensor.

In a further aspect, the module comprises a battery and/or an electrical connector for connecting the module to an external power source and/or a connector or receiver for connecting the module to an external controller.

The invention also relates to an apparatus as defined in the preamble of this specification, comprising a rechargeable battery and an internal controller for operating the actuators to dispense one or more fluids, wherein the apparatus further comprises an external controller, such as a laptop of desktop computer, and a database for preparing and transmitting instructions, e.g. for dispensing a recipe or formula comprising one or more, e.g. two to five different fluids, such as colorants, to the controller inside the apparatus, and wherein at least one of the controllers is arranged to assess the power required to carry out the instruction(s) and assess the power available in the battery. In an aspect, dispensing of fluid is prevented and/or a signal, e.g. a message or beep, is generated if the power available in the battery is insufficient, i.e. lower than the power required to carry out the instruction(s). In a further aspect, a signal, e.g. a message or beeps, is generated which indicates how many recipes or formulas can still be dispensed.

In these configurations, which can also be applied in embodiments not having the swappable module specified above, faulty dispensing, such as so-called miss-tints when dispensing colorants, e.g. in case of continued use of the apparatus by a shop owner relying on a UPS during an outage, can be avoided. Also, when this configuration is used in combination with an external controller that comprises a battery, e.g. a laptop, a(n expensive) UPS is in principle not required, at least not for preventing miss-tints.

To prevent faulty dispensing resulting from an interruption in data transfer from the external controller to the controller inside the apparatus, in a further aspect, the external controller is arranged to combine the instructions for dispensing two or more fluids, e.g. forming a recipe or formula, into a single set and transmit the set to the internal controller. In other words, instead of step by step transfer of instructions, a complete dispense job is transferred in a single instruction set enabling the dispenser to complete the job, even if communication with the external controller is temporarily lost.

The invention further relates to an apparatus as defined in the preamble, comprising stirring elements mounted rotatably inside the containers and partly extending from the containers and a drive mechanism for rotating the stirring elements. In an aspect, the parts of the stirring elements extending from the containers are provided with gears and the drive mechanism comprises a motor, an arm, and a driving gear mounted on the arm such that the driving gear is movable in and out of engagement with the gear on the stirring element of the container at the dispensing position.

In a further aspect, the drive mechanism comprises a further gear mounted on the drive shaft of the motor and coupled, by direct engagement or indirect engagement e.g. via one or more further gears or a belt or chain, to the driving gear.

In another aspect, in the engaged position, the arm and the (imaginary) line connecting the axis of rotation of the gear on the stirring element and the axis of rotation of the gear are at an angle in a range from 80° to 120°, preferably in arrange from 85° to 100°. Such angles provide a good balance between reinforcing engagement and actual transmission.

These configurations, which can also be applied in embodiments not having the swappable module or power and data arrangements specified above, require a limited number of parts and a single motor for both moving the driving gear in and out of engagement and driving the stirring elements. Yet, the risk of misalignment of the driving element and the driven stirring element is reduced or even avoided.

In an aspect of the invention aimed at reducing volume during transport, the apparatus comprises a hollow, e.g. substantially tubular or bucket-shaped, base for carrying the support, e.g. a turntable, during use. When the apparatus is disassembled, at least the containers, pumps, and valves can be stored inside the base, e.g. using the turntable as a lid.

In a further aspect, the base holding components of the disassembled apparatus is packaged in a box made of e.g. cardboard. Such a package in principle can be stored and transported without a pallet.

Assembly is facilitated if each of the containers forms, together with a valve and pump, a module that can be secured to the support, e.g. by snap fitting and/or a single attachment means, such as a screw or clip.

Within the framework of the invention, the term "fluid" is defined as any flowable material that can be dispensed by the apparatus according to the present invention. Examples of fluids include liquids, pastes, granulates, and powders. The term "stirring element" includes stirring elements comprising two or more components, e.g. comprising a transmission.

BRIEF DESCRIPTION OF THE DRAWINGS

FIGS. 11A and 11B illustrate the mounting of a module in the apparatus shown in FIGS. 9 and 10.

FIG. 12 is an exploded view of the module shown in FIGS. 11A and 11B.

The drawings are not necessarily to scale and details, which are not necessary for understanding the present invention, may have been omitted.

DETAILED DESCRIPTION OF THE DISCLOSURE

Figure 1:
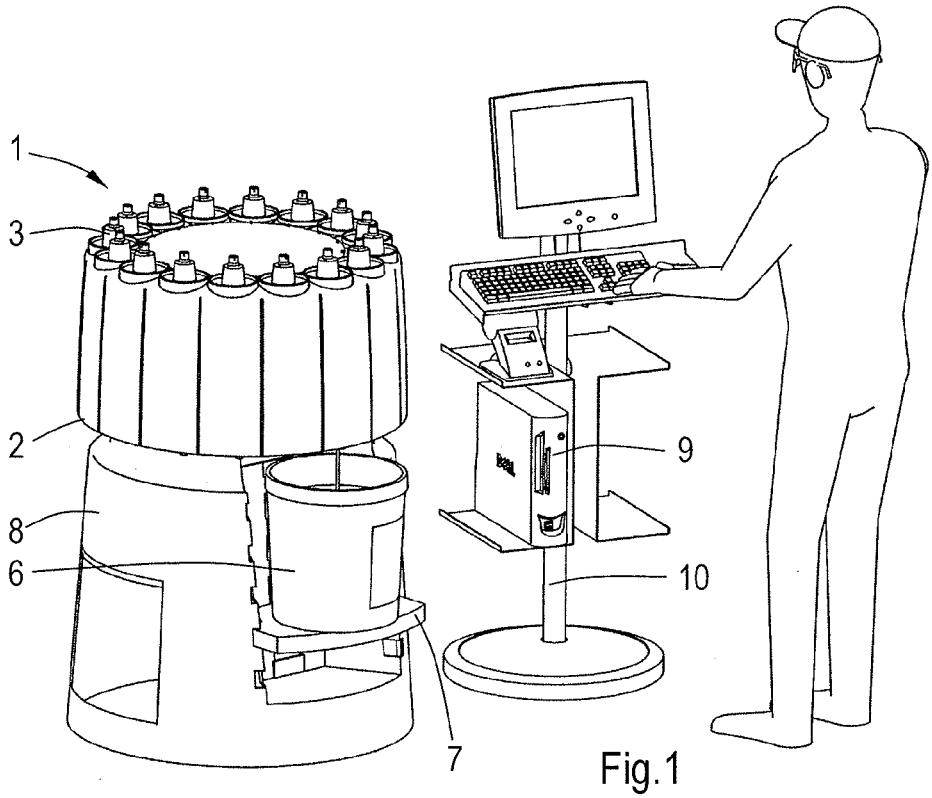
FIG. 1 is a perspective view of an apparatus for dispensing fluids according to the present invention in conjunction with an external computer system.

FIG. 1 shows an example of an apparatus 1 for dispensing a plurality of fluids, such as (components of) paints, paint colorants, hair dyes, shampoos, foundations, and the like. It can be used for dispensing numerous recipes and formulas of the said products and it can be located e.g. at a retailer of decorative paints, a hairdresser, or a spa, respectively.

Figure 2:
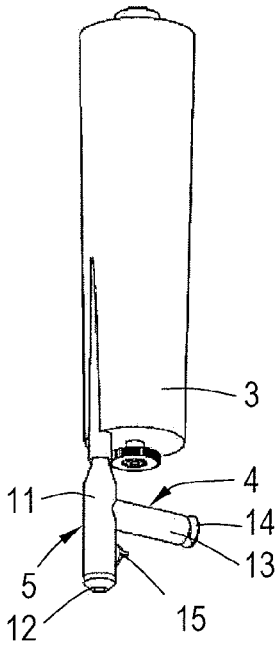
FIG. 2 is a perspective view of a module comprising a container, a pump, and a valve.
Figure 8:
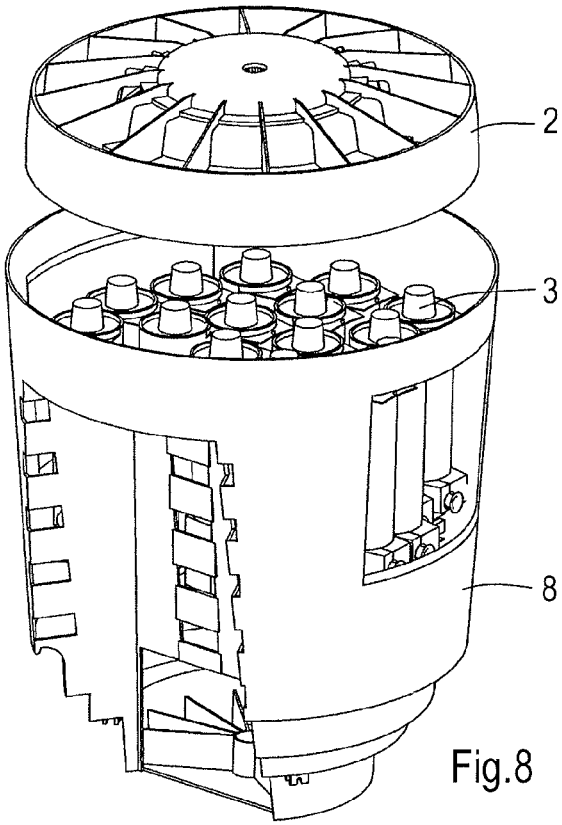
FIG. 8 shows the apparatus according to the present invention while it is being prepared for transport.

This particular dispensing apparatus 1 is an automated version and includes a horizontal turntable 2, with a plurality of containers 3 mounted along its circumference. Each container 3 is provided with a pump 4 and a dispense valve 5 (FIG. 2). The turntable 2 can be rotated between discrete positions, e.g. twelve or sixteen positions including a dispensing position, i.e. a position where the pumps and valves are operated by means of a central actuator, as will be explained in more detail below. Fluids are dispensed in a receptacle, in this example a bucket 6 on an adjustable shelf 7.

The apparatus 1 includes a base 8 made e.g. by injection moulding a polymer. A computer 9 for entering and storing information, such as customer data and recipes, and generating instructions for driving the turntable 2, pumps and valves, is positioned on a separate stand 10.

Further information regarding suitable turntables and procedures for driving the various components, are disclosed in, for instance, European patent applications EP 800 858, EP 1 492 970, EP 1 688 652, and EP 2 198 950.

As shown in FIG. 2, each valve 5 comprises a housing 11 fitted in or near the bottom of a container 3. The housing 11 comprises an outlet opening 12 in or near its bottom. The pump 4 is integrated in the valve 5 and comprises a cylinder 13 and a piston and piston rod slidably accommodated inside the cylinder 13. The piston rod is provided, on its proximal end, with a washer or flange 14. Further, the valve 5 comprises an operating element, e.g. a handle, lever, or, in this example, a rotary knob 15.

The valve 5 and rotary knob 15 provide three positions, a first or closed position wherein both the outlet opening and the connection between the container and the pump are closed, a second or intake position wherein the connection between the container and the pump is open and the outlet is closed, and a third or dispense position wherein the connection between the container and the pump is closed and the outlet is open.

Figure 3:
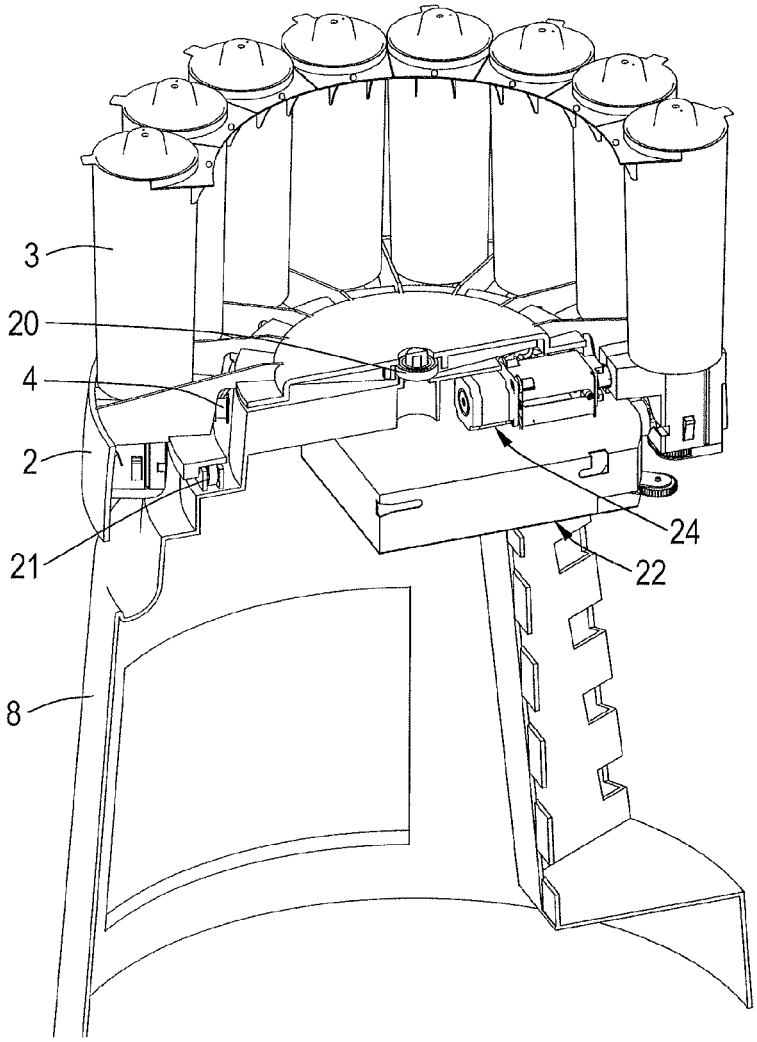
FIGS. 3 and 4 are cross-sections of the apparatus in FIG. 1 showing its entrails including a driving module according to the present invention.
Figure 4:
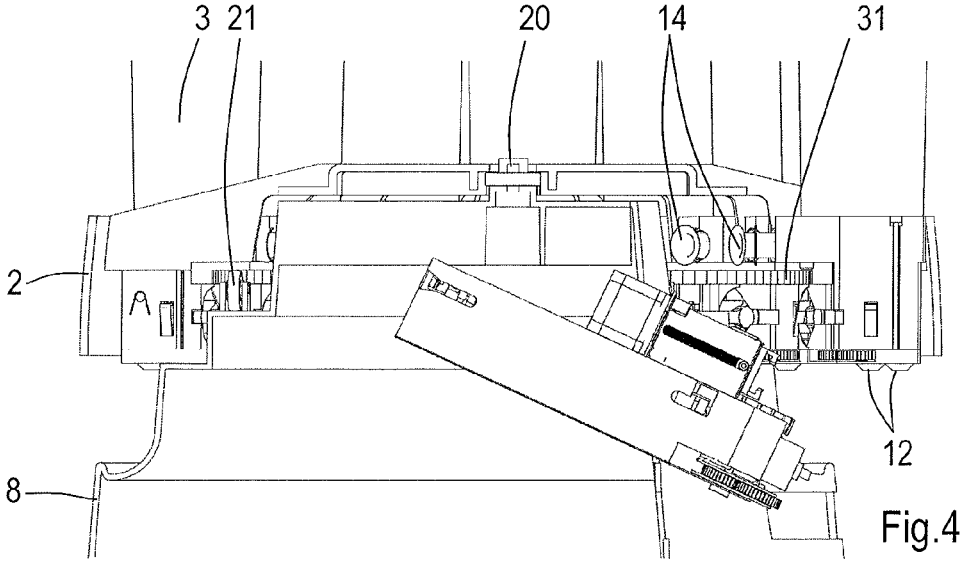

FIGS. 3 and 4 show the entrails of the dispensing apparatus, which include a central bearing 20 and a series of wheels 21 along an edge of the base 8 near its top, which bearing and wheels provide a low friction support for the turntable 2. A swappable module 22 is located beneath the turntable and within the ring of containers and pumps.

Figure 5:
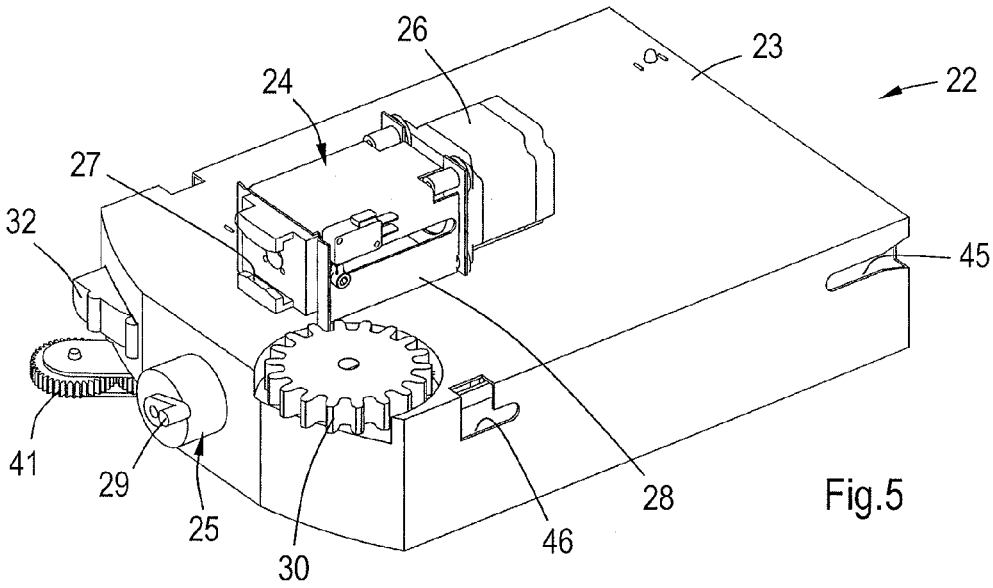
FIG. 5 is a perspective view of the driving module shown in FIGS. 3 and 4.

In this example, the module 22, shown in more detail in FIG. 5, comprises a housing 23 accommodating or carrying actuators 24, 25 for operating the pump 4 and valve 5 of the container 5 at the dispensing position. It further comprises motors and gears for driving the turntable and the stirring elements within the containers, as well as a sensor for establishing the position of the containers relative to the module and connectors (not shown) for connecting the module to an external power source and to the computer 9.

In this example, the actuator 24 for operating the pistons of the pumps 4 is located on top of the module 22 and comprises an electric motor 26, a lead screw (hidden from view) formed on or rigidly connected to the shaft of the electric motor 26 and extending radially with respect to the axis of rotation of the turntable 2. The actuator 24 further comprises a gripper 27 mounted on the lead screw by means of a nut or internal thread, and a guide 28 to prevent the gripper from rotating with the lead screw. The gripper 27 is shaped like a claw, which allows unobstructed rotation of the turntable and the pumps, but engages, when it is moved radially by rotating the lead screw, the flange 14 and hence the piston of the pump 4 in front of it, i.e. the pump 4 at the dispensing position.

The actuator 25 for operating the valves 5 is located in the front of the module 22 directly below the actuator 24 for the pistons and comprises an electric motor (inside the module) and, mounted on the shaft of the electric motor, an eccentric pin 29. Each of the rotary knobs 15 on the valves 5 comprises a slot or ridge extending perpendicular to and through the axis of the rotation of the rotary knob. When a valve is at the dispensing position, the axis of the rotation of the rotary knob is aligned with the axis of rotation of the motor of the actuator 25 enabling the eccentric pin to exert an eccentric force on the slot or ridge and thus rotate the knob to the desired position.

The drive mechanism for rotating the turntable comprises an electric motor (inside the module) and a gear 30. The gear 30 extends in a horizontal plane and is located, in this example, on top of the module 22. As a matter of course, the gear 30 could also be located on the bottom side of the module or protrude trough an opening in the housing of the module at a desired height. The gear intermeshes with an internal gear 31 provided in the turntable 2 (FIG. 4).

As is best shown in FIG. 5, the module 22 further comprises a micro switch 32 or, alternatively, a proximity sensor to cooperate with markers, e.g. protrusions or indeed notches or openings, in the turntable 2 or on the pumps. One of the markers differs, e.g. in length, seen along the circumference of the turntable 2, from the other markers and serves as a reference to establish the position of the turntable relative to the module 22 and thus relative to the dispensing position.

Figure 6:
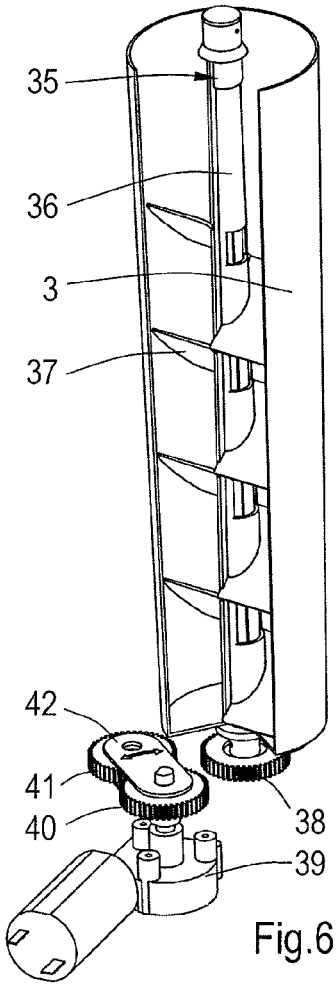
FIG. 6 is a perspective view of a drive mechanism for rotating stirring elements.

As shown in FIG. 6, each of the containers 3 comprises a stirring element 35 having a shaft 36 rotatably mounted in the bottom wall of the respective container. The section of the element that is inside the container comprises e.g. blades 37 or rods shaped to encompass a substantial part of the volume of the respective container. The end of the stirring element extending from the container is provided with a gear 38 to be engaged by a drive mechanism. In this example, the drive mechanism comprises an electric motor 39 and a first gear 40 mounted on the shaft of the motor. A second gear 41 intermeshes with the first gear 40 and is fitted to the first gear 40 by mean of two arms 42. The first and second gears 40, 41 extend in the same plane as the gear 38 on the stirring elements 35.

Figure 7A:
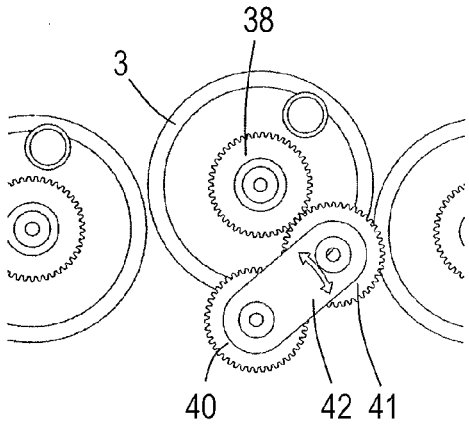
FIGS. 7A and 7B show, seen from below, the drive mechanism of FIG. 6 in engaged (7A) and disengaged (7B) positions.
Figure 7B:
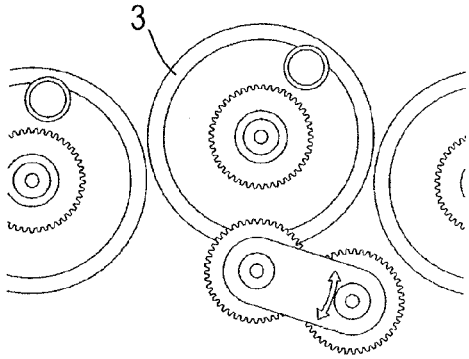

As illustrated in FIGS. 7A and 7B, if the first gear 40 is rotated counterclockwise, the second gear moves 41 towards and engages the gear 38 on the stirring element 35 of the container 3 at the dispensing position. Once engaged, the rotation of the first gear is transmitted, via the second gear, to the gear on the stirring element, resulting in the stirring of the contents of the container. Further, the first gear will continuously urge the second gear into engagement with the gear on the stirring element and/or, as long as the second gear is driven, it will pull itself into engagement with the gear of the stirring element. In this example (FIG. 7A), the arm and a line, connecting the axis of rotation of the gear on the stirring element and the axis of rotation of the second gear, are at an angle of slightly less than 90°.

If the direction of rotation of the motor is reversed, in these Figures to clockwise, the second gear will immediately disengage the gear on the stirring element and the stirring will cease.

The wall of the housing 23 of the module 22 comprises longitudinal slots 45 at or near the rear end and hooked slots 46 at or near the front end, cooperating with corresponding protrusions (not shown) on the inner wall of a bay inside the dispensing apparatus.

As shown in FIG. 4, the module can be installed by first connecting a power supply, e.g. by means of an integrated chassis connector, to the module and then establishing data communication, e.g. wireless or using an USB cable (connected to the computer), and sliding the longitudinal slots over the corresponding protrusions, tilting the module upwards and, once in place, pulling it outwards. Resilient elements can be provided to maintain the outward position.

During operation, the turntable is rotated by means of the drive mechanism about its central axis until it is established with the micro switch and the motor driving the turntable that the required container has reached the dispensing position. Subsequently, the actuators for the valve and the pump and the drive mechanism for the stirrer are activated as described above to dispense a fluid.

Figure 9:
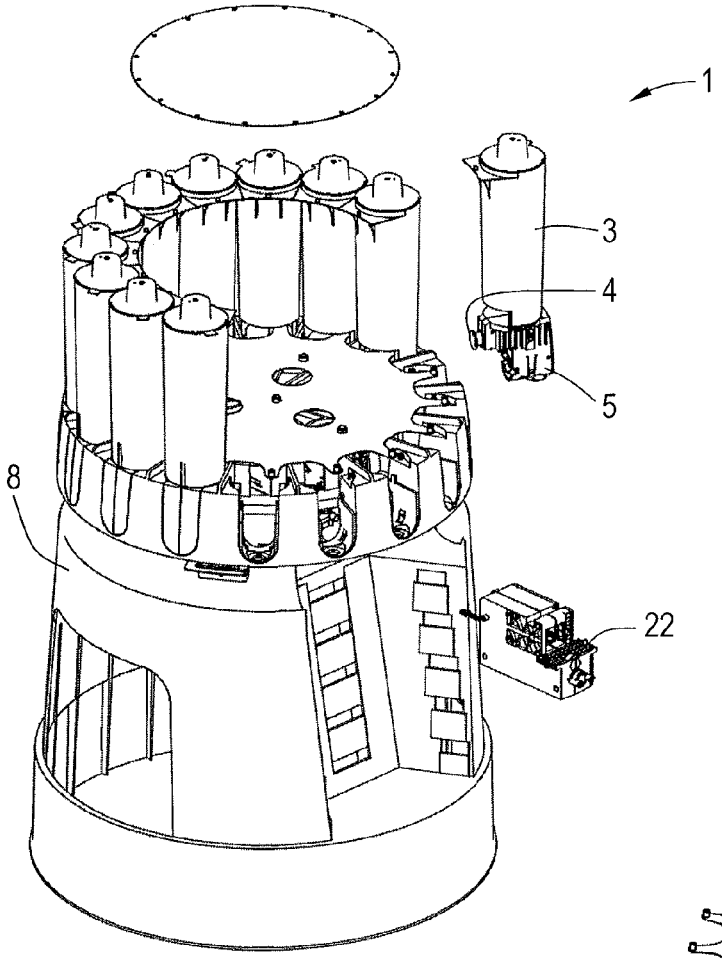
FIG. 9 is a perspective view of a further apparatus for dispensing fluids according to the present invention.
Figure 10:
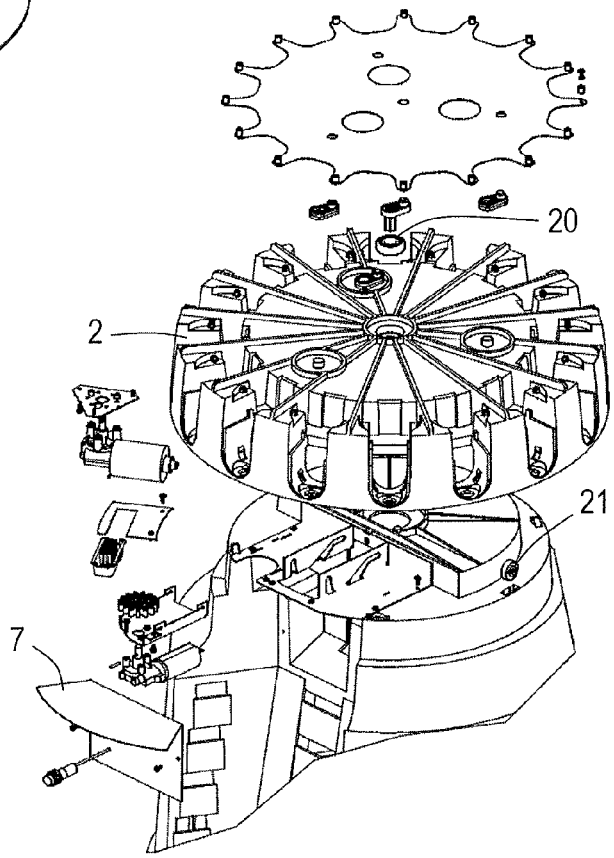
FIG. 10 is an exploded view of parts of the apparatus shown in FIG. 9.

FIGS. 9 and 10 show a second example of an apparatus 1 for dispensing a plurality of fluids. Similar to the apparatus shown in FIGS. 1 to 8, this dispensing apparatus 1 is an automated version including a horizontal turntable 2, with a plurality of containers 3 mounted along its circumference. Each container 3 is provided with a pump 4 and a dispense valve 5.

A swappable module 22 is located beneath the turntable and within the ring of containers and pumps. The module 22, shown in more detail in FIG. 11A to 12, comprises a housing 23 accommodating actuators 24, 25 for operating the pump 4 and the valve 5 of the container 3 at the dispensing position. However, in this example the motors and gears for driving the turntable and the stirring elements within the containers are located in the turntable, outside the module and in a manner known in itself, e.g. from EP 800 858.

As shown in FIGS. 11A and 11B, the module 22 can be installed by first connecting a power supply to the module and then establishing data communication, e.g. wireless or using an USB cable (connected to a computer), and sliding protrusions 45, 46 on either of the module in corresponding slots 47, 48 in the apparatus and below the turntable 2, tilting the module upwards and snap fitting it in its operating position. Resilient elements can be provided to maintain this position.

The actuator 24 for operating the pistons of the pumps 4 is located in a top section of the module 22 and comprises an electric motor 26, a lead screw 26A formed on or rigidly connected to the shaft of the electric motor 26 and, when the module 22 is installed in the apparatus 1, extending radially with respect to the axis of rotation of the turntable 2. The actuator 24 further comprises a gripper 27 mounted on the lead screw by means of a nut or internal thread. Guides 28 are defined in the housing 23 on either side of the actuator 24 and the gripper 27 comprises protrusions 27A slidingly positioned in the guides 28 to prevent the gripper 27 from rotating with the lead screw 26A.

The gripper 27 is shaped like a claw, which allows unobstructed rotation of the turntable and the pumps, but which engages, when it is moved radially by rotating the lead screw, the flange and hence the piston of the pump 4 in front of it, i.e. the pump 4 at the dispensing position.

The actuator 25 for operating the valves 5 is located in the front of the module 22 directly below the actuator 24 for the pistons and comprises an electric motor 25A and, mounted on the shaft of the electric motor, a pair of eccentric pins 29. As explained above, each of the rotary knobs 15 on the valves 5 comprises a slot or ridge extending perpendicular to and through the axis of the rotation of the rotary knob. When a valve is at the dispensing position, the axis of the rotation of the rotary knob is aligned with the axis of rotation of the motor of the actuator 25 enabling the eccentric pins to exert an eccentric force on the slot or ridge and thus rotate the knob to the desired position. Behind the pins 29 and inside the housing 23, an encoder wheel 50 is mounted on the shaft of the electric motor 25A. The encoder wheel 50 comprises marks, e.g. slots 51, that correspond to states (open, closed) of the valve 5 at the dispensing position, and stops 52 limiting rotation of the actuator e.g. to about 90°.

As is best shown in FIG. 12, the module 22 further comprises sensors 53, 54, 55 for establishing the position of the turntable 2, the position of the actuator 27A of the pump 4 and the position of the valve 5. In this example, the sensors are so-called slotted optical sensors which are, together with the controller 49 for operating the turntable and the pumps and valves to dispense fluid, mounted on the same substrate, such as a printed circuit board 56.

The sensor 53 for the position of the turntable 2 comprises a LED 53A and a corresponding receiver 53B to detect markers, e.g. protrusions on the pumps or, in this example, on the turntable 2. One of the markers differs, e.g. in width, seen along the circumference of the turntable 2, from the other markers and serves as a reference to establish the (zero) position of the turntable relative to the module 22 and thus relative to the dispensing position. The module 22 is provided in its top surface with a channel 22A allowing the protrusions to pass. The PCB 57 is provided with a recess 58 corresponding to the cross-section of the channel 22A. The LED 53A and receiver 53B are located on either side of the channel 22A and recess 58.

The sensor 54 for the gripper 27 is positioned about one of the guides 28 to enable it to detect the presence or absence of the protrusion 27A and thus the position of the gripper.

Similarly, the sensor 55 for the state of the valve is positioned about the circumference of the encoder wheel to detect the slots 51 and, in this example, the ends of the slots defining the open and closed states of the valve.

The housing comprises at least one transparent or translucent portion, e.g. located in its bottom side, or part, e.g. a lid 23A that is translucent in its entirety, to allow an operator or maintenance mechanic to check from the outside and without removing the module, optical signals from LEDs on the substrate 56 reflecting the status of one or more components or functions.

As a matter of course, this disclosure is not restricted to the above-disclosed embodiments, which may be varied in different manners within the spirit and scope of the invention. For example, the apparatus according to the present invention can be configured as a linear dispensing apparatus i.e. with the containers aligned is a row. Also, instead of stirring during dispensing, stirring can be postponed to periods when no dispensing takes place, which enables more systematic stirring.

What is claimed is:

1. An apparatus for dispensing a plurality of fluids, comprising a support, a plurality of containers for holding a fluid and mounted on the support, pumps and valves connected to respective containers, at least a common actuator for sequentially operating the pumps and a common actuator for sequentially operating the valves to dispense fluid and a drive mechanism for moving the support, and thus the containers, pumps, and valves on the one hand and the actuator on the other relative to each other, characterized in that the common actuator for sequentially operating the pumps and the common actuator for sequentially operating the valves are integrated in a module, which module is releasably mounted in the apparatus on a side of the containers remote from a point of dispensing.

2. The apparatus according to claim 1, wherein the module is positioned beneath the support and/or behind the pumps.

3. The apparatus according to claim 1, wherein the pumps are piston-pumps and extend radially.

4. The apparatus according to claim 1, wherein the module comprises sensors for the position of the support, the position of the pump and/or its actuator, and the state of the valve and/or the position of its actuator, and a controller for operating the actuators and thus the pumps and valves to dispense fluid.

5. The apparatus according to claim 4, wherein the controller and at least one of the sensors are mounted on the same substrate.

6. The apparatus according to claim 1, wherein all sensors, motors, and a controller for operating the pumps and valves to dispense fluid are integrated in the module.

7. The apparatus according to claim 1, wherein replacing the module with an identical module merely requires disconnecting power and data communication and mechanically disengaging the module and subsequently mechanically engaging and connecting power and data communication of the replacement module.

8. The apparatus according to claim 1, wherein the module comprises a battery and/or an electrical connector for connecting the module to an external power source and/or a connector or receiver for connecting the module to an external controller.

9. The apparatus according to claim 8, wherein the module comprises a rechargeable battery and a controller for operating the actuators to dispense one or more fluids, wherein the apparatus further comprises an external controller and database for preparing and transmitting instructions to the controller in the module, and wherein at least one of the controllers is arranged to assess the power required to carry out the instruction(s) and assess the power available in the battery.

10. The apparatus according to claim 9, wherein dispensing of fluid is prevented if the power available in the battery is lower than the power required to carry out the instruction(s).

11. The apparatus according to claim 9, wherein the apparatus is arranged to generate a signal if the power available in the battery is lower than the power required to carry out the instruction(s).

12. The apparatus according to claim 9, wherein the external controller is arranged to combine the instructions for dispensing two or more fluids into a set and transmit the set to an internal controller.

13. The apparatus according to claim 1, comprising stirring elements mounted rotatably inside the containers and partially extending from the containers and a drive mechanism for rotating the stirring elements, which drive mechanism is integrated in the module.

14. The apparatus according to claim 13, wherein, during engagement, an arm and a line connecting an axis of rotation of a gear on the stirring element of a container at a dispensing position and an axis of rotation of a driving gear are at an angle in a range from 80° to 120°.

15. The apparatus according to claim 1, comprising a hollow base for carrying the support, wherein at least the containers, pumps, and valves fit inside the base when the apparatus is disassembled.

16. The apparatus according to claim 3, wherein the piston-pumps extend horizontally.

* * * * *